US008586148B2

(12) United States Patent
Bisht et al.

(10) Patent No.: US 8,586,148 B2
(45) Date of Patent: Nov. 19, 2013

(54) LOW VOLTAGE NEAR-FIELD ELECTROSPINNING METHOD AND DEVICE

(75) Inventors: Gobind S. Bisht, Irvine, CA (US); Giulia Canton, Irvine, CA (US); Marc Madou, Irvine, CA (US); Alireza Mirsepassi, Irvine, CA (US); Derek Dunn-Rankin, Irvine, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 13/415,758

(22) Filed: Mar. 8, 2012

(65) Prior Publication Data

US 2012/0244291 A1 Sep. 27, 2012

Related U.S. Application Data

(60) Provisional application No. 61/466,871, filed on Mar. 23, 2011.

(51) Int. Cl.
*B05D 1/04* (2006.01)
*B05D 1/40* (2006.01)

(52) U.S. Cl.
USPC ..... 427/458; 427/480; 427/472; 118/621

(58) Field of Classification Search
USPC ..... 427/458, 472, 480; 118/621; 264/454–485
See application file for complete search history.

(56) References Cited

U.S. PATENT DOCUMENTS

| | | | | |
|---|---|---|---|---|
| 7,323,540 | B2 * | 1/2008 | Velev et al. | 528/502 F |
| 8,388,994 | B1 * | 3/2013 | Scheer et al. | 424/423 |
| 2011/0300347 | A1 * | 12/2011 | Yoon et al. | 428/195.1 |
| 2012/0153236 | A1 * | 6/2012 | Cakmak et al. | 252/511 |

OTHER PUBLICATIONS

Chang et al., "Continuous Near-Field Electrospinning for Large Area Deposition of Orderly Nanofiber Patterns", Sep. 24, 2008, Berkeley Sensor and Actuator Center, Department of Mechanical Engineering, University of California, vol. 93, Issue 12, p. 1-4.*

Chang, C., K. Limkrailassiri, et al. (2008). "Continuous near-field electrospinning for large area deposition of orderly nanofiber patterns." Applied Physics Letters 93: 123111.

Kim, H. Y., M. Lee, et al. (2010). "Nanopottery: Coiling of Electrospun Polymer Nanofibers." Nano Letters 10(6): 2138-2140.

Sun, D., C. Chang, et al. (2006). "Near-Field Electrospinning." Nano Letters 6(4): 839-842.

Zheng, G., W. Li, et al. (2010). "Precision deposition of a nanofibre by near-field electrospinning." Journal of Physics D: Applied Physics 43: 415501.

Wang, C. et al., A novel method for the fabrication of high aspect ratio CMEMS structures, J. Microelectromech System, vol. 14, No. 2, pp. 348-358 (2005).

(Continued)

*Primary Examiner* — Frederick Parker
*Assistant Examiner* — Ann Disarro
(74) *Attorney, Agent, or Firm* — Vista IP Law Group LLP

(57) ABSTRACT

An electrospinning method includes providing a nozzle fluidically coupled to a source of polymer ink and providing a substrate adjacent to the nozzle. A first voltage is applied to the nozzle to initiate electrospinning of the polymer ink onto the substrate, wherein the first voltage is within the range of about 400V to about 1000V. The voltage is then reduced to a second, lower voltage wherein the voltage is within the range of about 600V to about 150V.

12 Claims, 15 Drawing Sheets

(56) References Cited

OTHER PUBLICATIONS

Chang, C. et al., Continuous Near-Field Electrospinning for Large Area Deposition of Orderly Nanofiber Patterns, Appl. Phys. Lett. 93, 123111-1-123111-3 (2008).
Sun, D. et al., Near-field electrospinning, Nano Lett., 6(4), 839-42 (2006).
Kudryashov, V. et al., Grey scale structures formation in SU-8 with e-beam and UV, Microelectron Eng. 67-68,306-311 (2003).
Malladi, K. et al., Fabrication of suspended carbon microstructures by e-beam writer and pyrolysis, Carbon, 44, 2602-2607 (2006).
Hongzhi, C. et al., Development of Infrared Detectors Using Single Carbon-Nanotube-Based Field-Effect Transistors, Nanotechnology, IEEE Transactions on, vol. 9, No. 5, pp. 582-589 (2010).

* cited by examiner

LOW VOLTAGE NEAR-FIELD ELECTROSPINNING METHOD AND DEVICE

RELATED APPLICATION

This Application claims priority to U.S. Provisional Patent Application No. 61/466,871, filed on Mar. 23, 2011, which is hereby incorporated by reference in its entirety. Priority is claimed pursuant to 35 U.S.C. §119.

STATEMENT REGARDING FEDERALLY SPONSORED RESEARCH OR DEVELOPMENT

This invention was made with government support under grant CBET-0709085 awarded by the National Science Foundation. The government has certain rights in the invention.

FIELD OF THE INVENTION

The present invention pertains to methods that use low-voltage, near-field electrospinning to allow for the controlled and continuous electrospinning of nanofibers. The electrospinning system uses a superelastic polymer ink at low voltage so that the nanofibers may be controlled and patterned.

BACKGROUND

Fabrication of polymeric nanofibers may be used in a wide variety of applications such as in the fields of sensors and actuators, energy storage, smart textiles, optoelectronics, tissue engineering, medical device fabrication, prosthetics, drug delivery, microresonators, and piezoelectric energy generators. Several processes have been developed to tailor the properties of polymeric nanofibers to suit the particular needs of each application. These polymeric nanofiber modification techniques include chemical modification, surface deposition of metals, functional doping, and composite formation. Polymeric nanofibers can also be pyrolyzed to yield thinner carbon nanofibers, opening up an even wider range of applications, including electrochemical sensors and energy storage.

Polymeric nanofibers may be useful as diodes. The Schottky diode is a semiconductor diode with a low forward voltage drop and a fast switching action. When current flows through a diode there is a small voltage drop across the diode terminals. A normal silicon diode has a voltage drop between 0.6-1.7 volts, while a Schottky diode voltage drop is between approximately 0.15-0.45 volts. This lower voltage drop can provide higher switching speed and better system efficiency.

To form a Schottky diode, a metal-semiconductor junction is formed between a metal and a semiconductor, creating a Schottky barrier instead of a semiconductor-semiconductor junction as in conventional diodes. Typical metals used are molybdenum, platinum, chromium or tungsten; and the semiconductor would typically be N-type silicon. The metal side acts as the anode and N-type semiconductor acts as the cathode of the diode. This Schottky barrier results in both fast switching and low forward voltage drop.

One of the key factors in the utilization of polymeric nanofibers in many of the aforementioned applications is the ability to accurately control the physical properties and positioning (patterning) of the produced nanofibers. One option for continuous patterning of polymer nanofibers is far-field electrospinning (FFES), which is a well-known technique to produce polymeric nanofiber mats in large quantities. Conventional Far-Field Electrospinning (FFES) involves application of 10 to 15 kV to propel a polymer jet from a biased syringe nozzle towards a grounded substrate electrode. Typically in FFES, the syringe-to-substrate distance is in the range of several centimeters, e.g., around 10-15 cm. Unfortunately, the high voltage used in FFES causes bending instabilities in the jet that leads to chaotic whipping motion of the depositing nanofibers. This whipping motion makes it difficult to control the position of where the nanofibers land on the substrate.

Although work has been carried out to achieve alignment of nanofibers along a prescribed direction through the use of a rotating drum collector, and by using electrical field manipulation, precise 2D and 3D patterning is still very difficult to achieve with FFES.

Recent efforts on a variant of electrospinning called near-field electrospinnning (NFES) produced some encouraging initial results, opening up a possibility of achieving scalable precision patterning with polymeric nanofibers. NFES offers the advantage of large scale manufacturability (inherent in electrospinning) combined with controlled electric field guidance (due to a reduced distance between the source and collector electrodes). However, the reported efforts required the use of electric fields well in excess of 200 kV/m for continuous NFES operation so that the resulting polymer jets still exhibit bending instabilities and thus limited control of polymeric nanofiber patterning. For example, Chang et al. disclose continuous near-field electrospinning for large area deposition of orderly nanofiber patterns using an electric field of at least 1,200 kV/m (applied voltage of 600V to syringe needle). See Chang et al., Continuous Near-Field Electrospinning For Large Area Deposition of Orderly Nanofiber Patters, Appl. Phys. Lett. 93, 123111 (2008).

SUMMARY

In one embodiment, an electrospinning method includes providing a nozzle fluidically coupled to a source of polymer ink and providing a substrate adjacent to the nozzle. A first voltage is applied to the nozzle to initiate electrospinning of the polymer ink onto the substrate, wherein the first voltage is within the range of about 400V to about 1000V. The voltage is then reduced to a second, lower voltage wherein the voltage is within the range of 150V to about 600V.

In another embodiment, an electrospinning device includes a moveable stage configured to hold a substrate; an electrode nozzle disposed at a distance from the moveable stage; a power source operatively coupled to the electrode nozzle and the substrate; a controller operatively coupled to the moveable stage and the power source, the controller controlling the relative speed between the moveable stage and the electrode nozzle as well as an applied voltage to the nozzle by the power source.

BRIEF DESCRIPTION OF THE DRAWINGS

As seen in FIG. 5B, a slower stage speed results in a thicker fiber while a faster stage speed results in a thinner fiber.

DETAILED DESCRIPTION OF THE ILLUSTRATED EMBODIMENTS

Figure 1A:
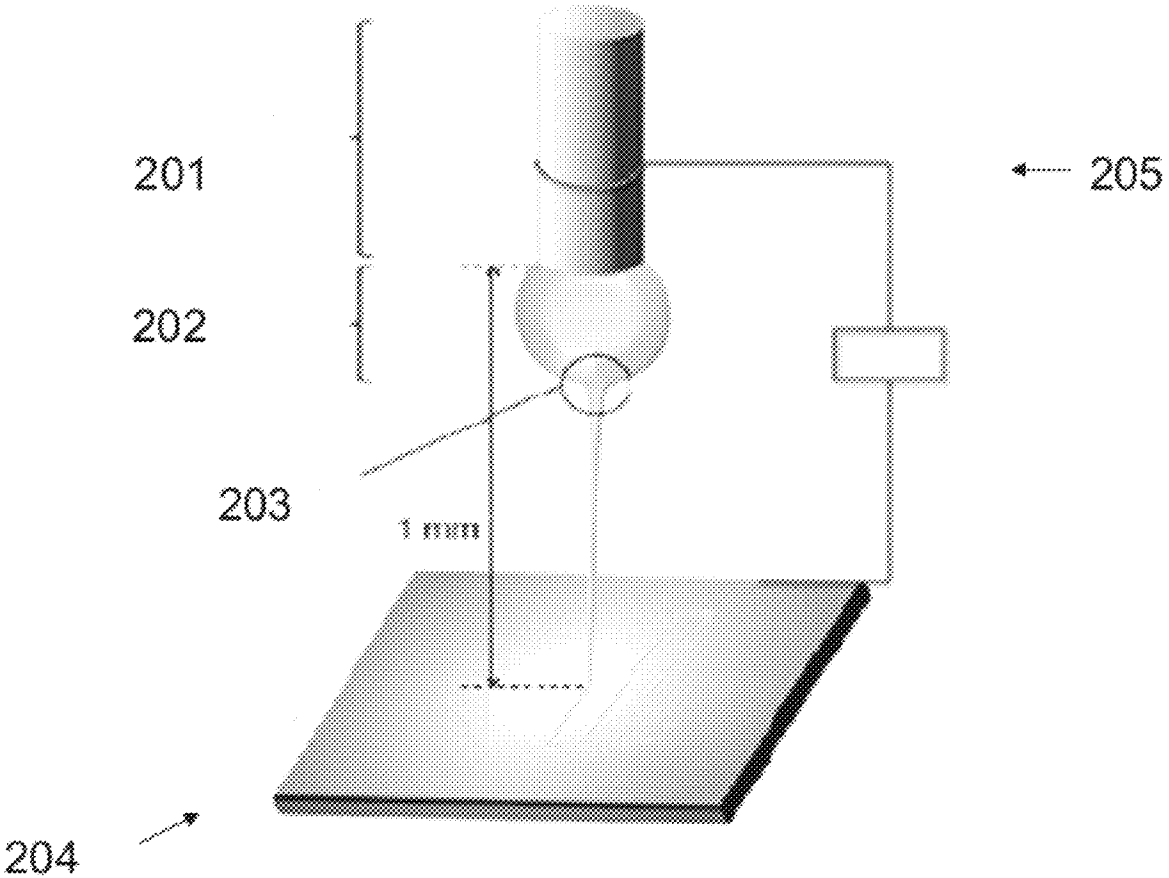
FIG. 1A is a schematic illustration of the typical components of a NFES system.
Figure 2:
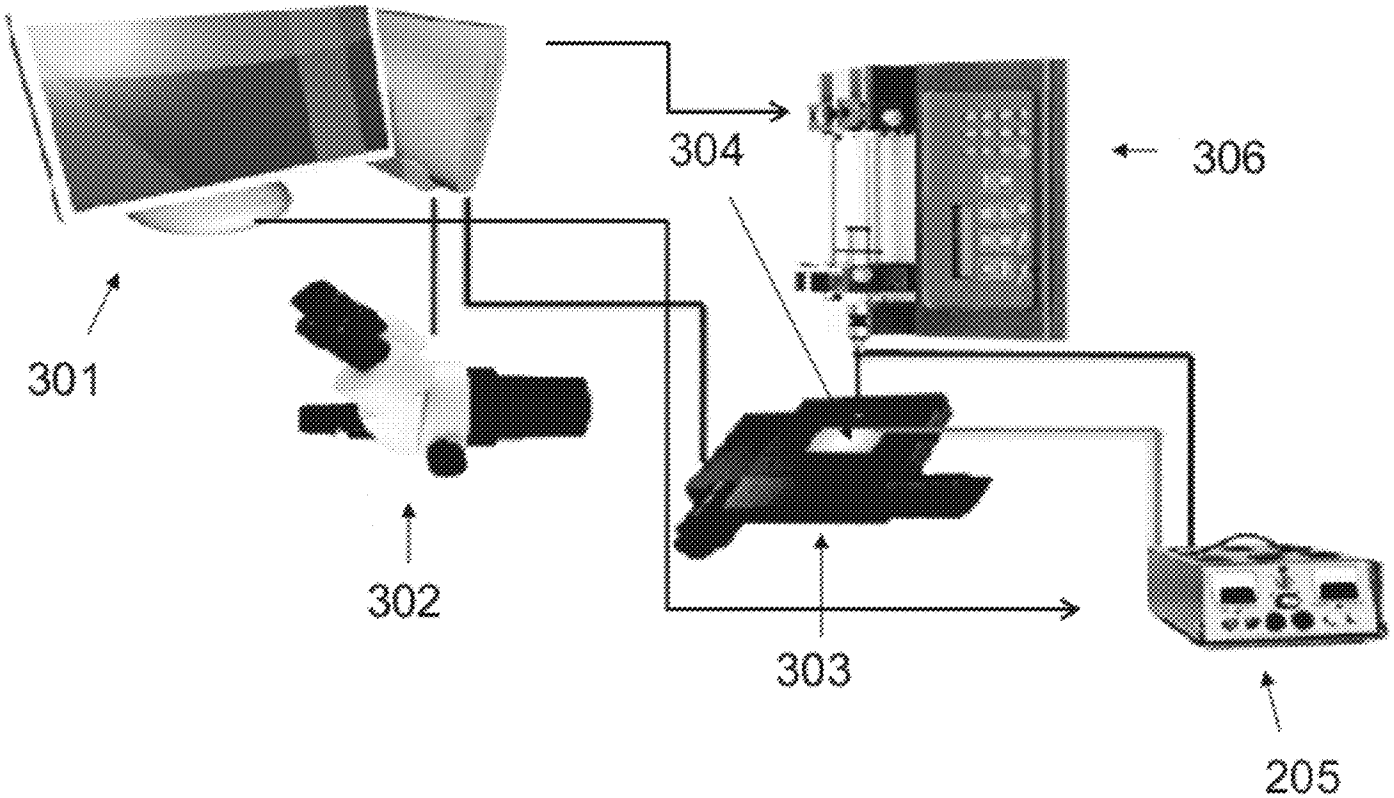
FIG. 2 is a schematic illustration of additional components of a NFES system.

FIG. 1A shows a typical NFES system 200. The system 200 includes a dispensing electrode nozzle 201. A polymer droplet 202 is illustrated at the end of the dispensing electrode nozzle 201. A Taylor Cone 203 is generated near the polymer droplet 202 and a polymer jet is stretched by the electric field whereby the polymer contacts the substrate 204. As explained below, the substrate 204 may be a two dimensional substrate (e.g., wafer) or in other embodiments, the substrate 204 is a three-dimensional substrate (or a two-dimensional substrate with three-dimensional features formed or disposed thereon). A high voltage power supply 205 is coupled to the dispensing electrode nozzle 201 and the substrate 204 with the substrate 204 acting as ground. The distance from the dispensing electrode nozzle 201 to substrate 204 can be adjusted using an x-y-z motion stage 303 as seen in FIG. 2. In an alternative embodiment, the stage that holds the substrate 204 may be stationary and the dispensing electrode nozzle 201 is moveable in at least one of the x, y, and z directions. The NFES system 200 may also include an optional computer, 301, as shown in FIG. 2, a microscope or camera 302 to record or observe the nanofibers, and an x-y-z motion stage 303 on which a substrate 304 is mounted to collect the nanofibers. The NFES system 200 further includes a power supply 205 that applies the voltage to the dispensing electrode nozzle 201. The computer 301 may also be used to control the power supply 205. A pump 306 such as a syringe pump is loaded with polymer and (or a container fluidically coupled to the pump is loaded with polymer) is activated to provide a continuous source of polymer to the dispensing electrode nozzle 201.

The computer 301 may include software stored therein (e.g., LabView or some other software) that is used control various aspects of the system. For example, the computer 301 may control the voltage levels (timing of their application to the nozzle 201) that are applied to the dispensing electrode nozzle 201. The computer 301 may also control other components of the system like the motion stage 303 (e.g., patterns, speed, acceleration, deceleration, and distance between nozzle and substrate). The computer 301 may also control the pump 306. Image acquisition and data analysis, if needed, can also be implemented using the computer 301.

Figure 1B:
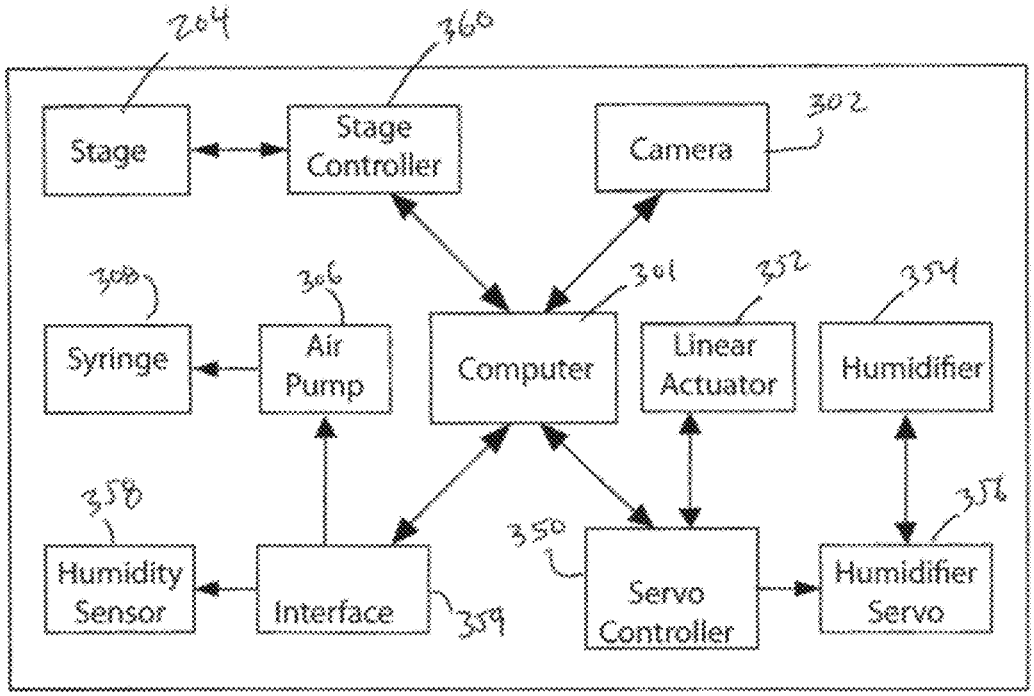
FIG. 1B illustrates a block diagram for the control architecture, according to one embodiment, for implementing the method of low voltage NFES (LV-NFES).

FIG. 1B illustrates a block diagram for the control architecture, according to one embodiment, for implementing the method of low voltage NFES (LV-NFES). As seen in FIG. 1B, the computer 301 interfaces with camera 302. The computer 301 also interfaces with a servo controller 350 (Phidgets 1061 Advanced Servo 8-motor controller) that is used to control a linear actuator 352 and humidifier 354 (via humidifier servo 356). The linear actuator 352 is used disrupt the polymer droplet on the nozzle 201 with a sharp tungsten or glass tip. The humidifier 354 controls the relatively humidity surrounding the device. A relatively humidity of around 60% permits the formation of stable and continuous patterns. A humidifier 354 with a feedback control from a humidity sensor 358 (via interface 359) such as the Phidgets 1125 Humidity/Temperature sensor may be used and maintains a relative humidity within +/−3%. The computer 301 also interfaces with an pneumatic pump 306 that that is connected to a syringe 308 that dispenses the polymer ink. The computer 301 interfaces with the x-y-z stage 204 via stage controller 360.

In one embodiment, a LV-NFES method is initiated with a first or initiation voltage between the range of about 1000V to about 400V and then the voltage is dropped to a second, operating voltage as low as 200V. For example, the second, operating voltage may be within the range of about 600V to about 150V. The method uses a superelastic polymer solution pumped through a nozzle 201 (e.g., needle) to allow for continuous and controlled electrospinning of polymeric nanofibers. The operating distance between the nozzle 201 and the substrate 304 for this NFES set-up may adjustable by is approximately 1 mm. In some instances, the distance is between about 1 mm and several mm (e.g., 3 mm) This method is intended to address the problem of bending instabilities caused by the high voltage used in NFES. By using a lower voltage, the bending instabilities of the polymer jet are reduced and better control of the polymer jet is enabled allowing for better positioning of the resulting nanofiber formed by LV-NFES.

Figures 3A, 3B, 3C, 3D:
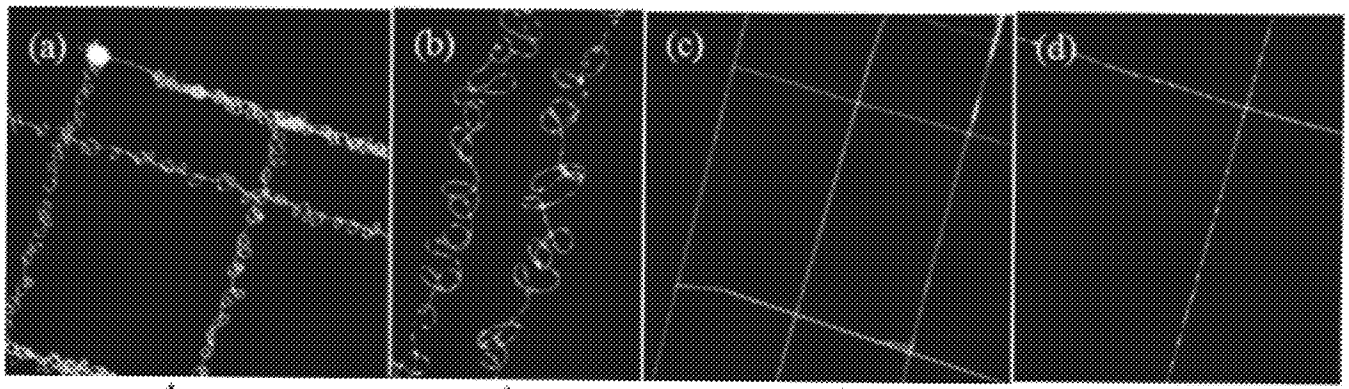
FIGS. 3A and 3B show the deposition pattern of the polymer jet when the applied voltage is 600 V and the nanofibers are formed from a polymer ink of 2% wt PEO in an aqueous solution. The snakelike pattern is believed to occur due to high-speed oscillatory bending instability in the jet. Deposition is done at a stage speed (linear) of 10-40 mm/s.
FIGS. 3C and 3D show the deposition pattern of the polymer jet when the voltage is 300V and the nanofibers are formed from a polymer ink of 2% wt PEO in an aqueous solution. Deposition is done at a stage speed (linear) of 10-40 mm/s.

A superelastic polymer solution is one that can be stretched to enormous strains without breaking. Solutions of such superelastic polymers contain long entangled polymer chains that promote stretchability and are expected to augment continuity of the electrospun jets. This facilitates the continuous electrospinning of the polymer jet into nanofibers. Nanofibers produced at a voltage of 600V with a superelastic polymer such as polyethylene oxide (PEO) in a 2% wt solution in deionized water are shown in FIGS. 3A and 3B. FIGS. 3A and 3B illustrate the looped nanofibers caused by the high-speed oscillatory bending instability of the polymer jet. The same solution of PEO 2% wt in deionized water produces straight, aligned nanofibers at 300V as shown in FIGS. 4C and 4D without the looped nanofibers at 600V. The lower voltage of 300V minimizes the bending instabilities of the polymer jet so that nanofibers may be controlled and aligned.

Figure 4B:
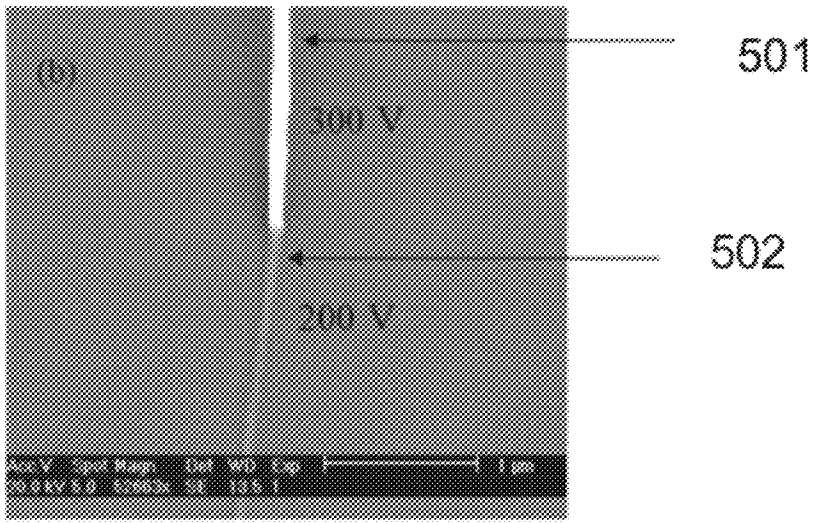
FIG. 4B is a scanning electron microscope (SEM) image of a continuously electrospun nanofiber with an abrupt change in voltage which corresponds to a voltage reduction from 300V to 200V.
Figure 4A:
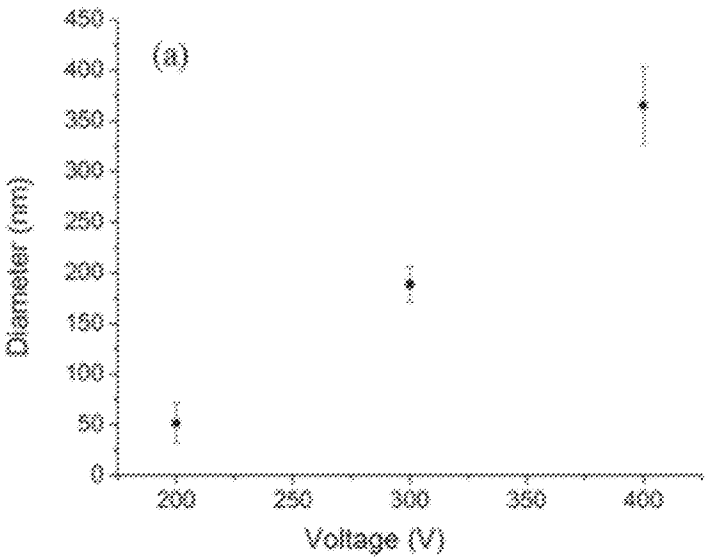
FIG. 4A illustrates a graph showing the diameter of the nanofiber (i.e., nanofiber thickness) as a function of voltage applied between the nozzle and the substrate.

The diameter of the nanofibers may also be varied by changing the voltage. In FIG. 4A, a graph of nanofiber diameter as a function of voltage is presented. As seen in FIG. 4A, at higher voltages, the nanofiber is thicker and with lower voltage, the nanofiber is thinner. The SEM image of a nanofiber in FIG. 4B shows the nanofiber's reduction in diameter as the voltage was changed from 300V to 200V. A noticeable decrease can be seen. In FIG. 4B a thicker nanofiber 501 is formed at 300V and a thinner fiber 502 is firmed at 200V.

Figure 5B:
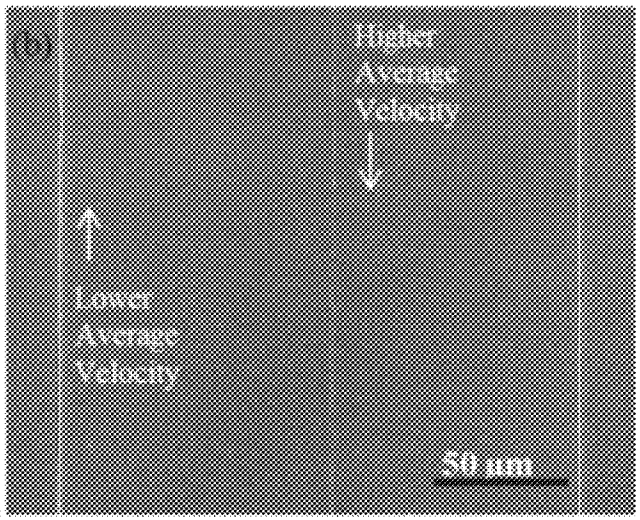
FIG. 5B illustrates a SEM image of aligned nanofibers continuously electrospun according to the programmed pattern. Fiber thickness is shown to depend on the velocity of X-Y stage.
Figure 5A:
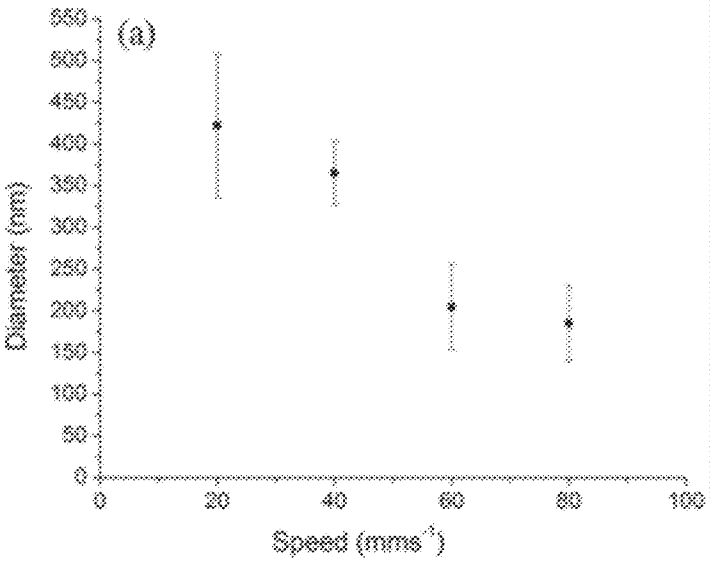
FIG. 5A illustrates a graph showing the diameter of the nanofiber (i.e., nanofiber thickness) as a function of stage speed. The same pattern has been set for all the samples, while the maximum speed varies (applied voltage: 400V).
Figure 6:
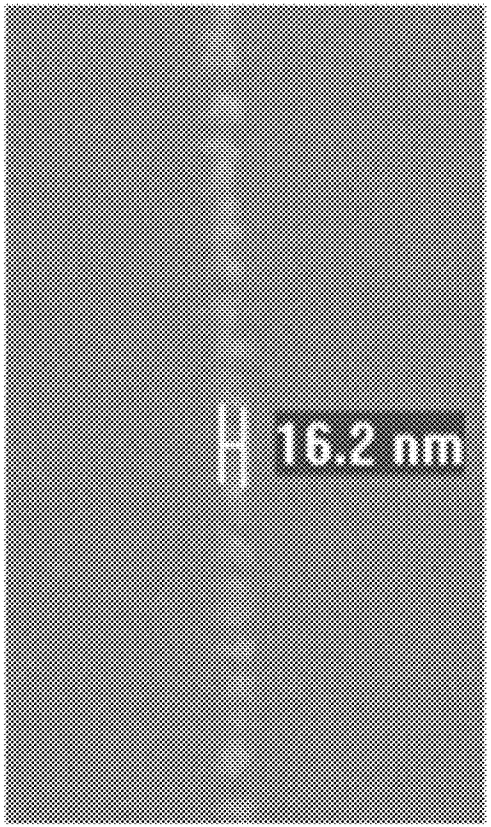
FIG. 6 is a SEM image of a nanofiber patterned directly with low voltage NFES at 200V. The fiber was coated with 6 nm Pd/Au to improve SEM resolution.
Figure 7:
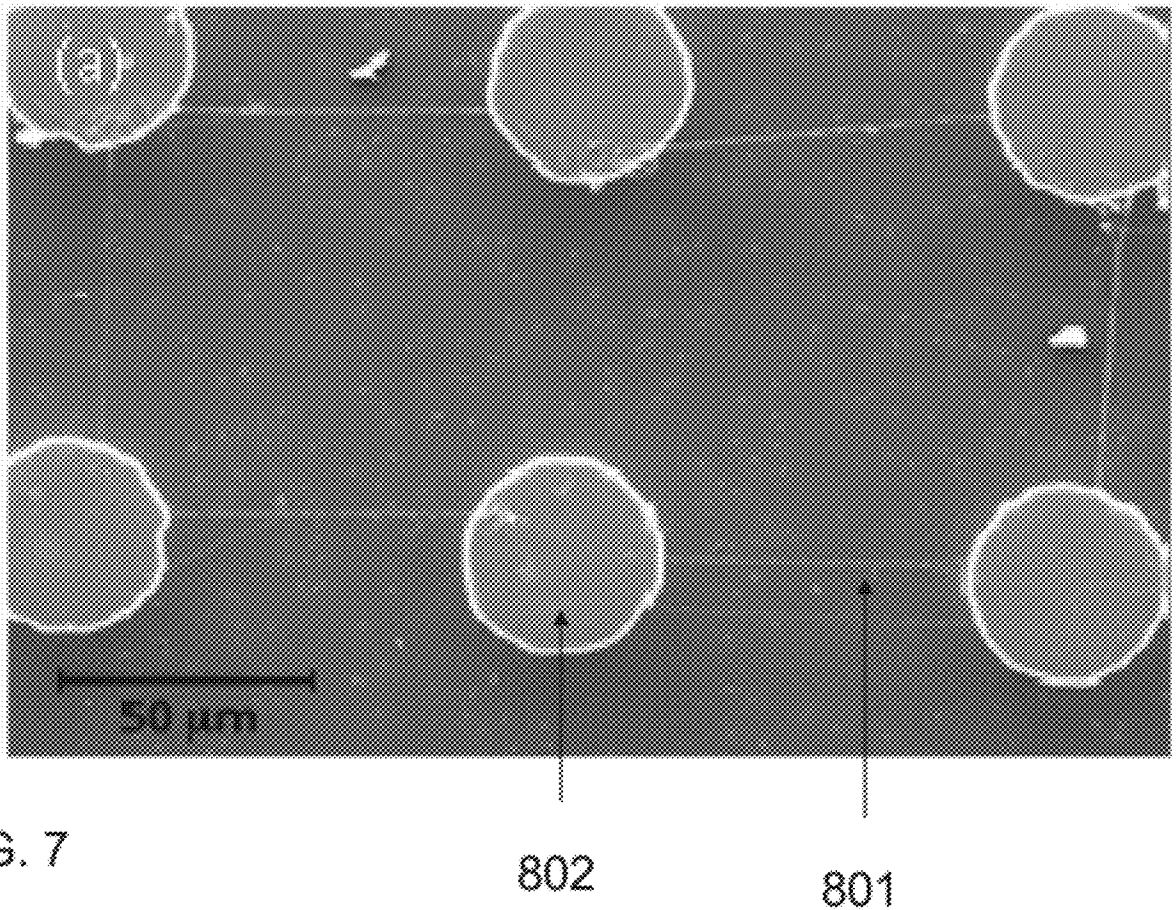
FIG. 7 is a SEM image of multiple nanofibers suspended on CMP arrays deposited by continuous NFES of viscoelastic 2 wt % PEO polymer at 300V. Six (6) posts are connected to each other by nanofibers.

In another embodiment, the method may be used to produce a nanofiber that is deposited on a substrate 304 and then a mechanical force caused by the movement of an x-y-z stage 303 may pull the nanofiber to thin the fiber. FIG. 5A illustrates a graph of the speed of the x-y-z stage as a function of the diameter of the nanofiber. As seen in FIG. 5A, the faster the x-y-z stage moves, the thinner the nanofiber. FIG. 5B shows the SEM images of the thickness of nanofibers produced by varying speeds of the x-y-z stage. FIG. 6 illustrates an SEM image of a 16.2 nm nanofiber produced by the x-y-z stage moving at a speed of 100 $mms^{-1}$ away from the nozzle such that the polymer jet is stretched (in the x-y plane) at a nozzle voltage of 200V. In one embodiment, the mechanical force may be caused by the x, y, or z movement of the x-y-z stage 303. This movement may position the generated nanofiber onto a different substrate or structure located on the same substrate. As an example, FIG. 7 illustrates multiple nanofibers 801 suspended on CMP arrays deposited by continuous NFES of viscoelastic 2 wt % PEO polymer at an applied voltage of 300V. Six (6) posts 802 are connected to each other by nanofibers 801.

In one aspect of the invention, an electrospinning ink can be formed by combining a conducting polymer with a superelastic polymer solution to form electrospinning ink. As one example, a conducting polymer such as Poly (3,4-ethylenedioxythiophene):poly(styrenesulfonate) (PEDOT:PSS) may be combined with the superelastic polymer solution. The electrospinning ink may be prepared by mixing high molecular weight PEO with an aqueous dispersion of the conducting polymer PEDOT:PSS using a magnetic stir bar over an extended period of time (e.g., overnight).

In another aspect of the invention, an electrospinning ink can be made by combining PEO with a carbonizable negative photoresist such as SU8. SU8 can be pyrolysed into monolithic carbon structures after they have been crosslinked by UV exposure. See C. Wang, G. Jia, L. Taherabadi, and M. Madou, "A novel method for the fabrication of high-aspect ratio C-MEMS structures," *Microelectromechanical Systems, Journal of* vol. 14, no. 2, 2005, pp. 348-358, which is incorporated by reference herein.

The following are working examples of LV-NFES.

PEO Polymer Solution

High molecular weight polyethylene oxide (MW=4000000) from Dow Inc. (WSR-301) was tested as the superelastic polymer ink at 1, 2, and 3 wt %, respectively, in deionized (DI) water. To obtain homogeneous PEO solutions, the PEO and the DI water were allowed to freely diffuse for 24 h followed by 96 h of vortex mixing in a single stirrer turbine at 30 rpm.

The low-voltage NFES experimental set-up used a 3 mL syringe bore fitted with a 27 gauge (200 μm i.d.) type 304 stainless steel needle as the nozzle 201 and was mounted on a syringe pump (Harvard Apparatus, PHD 70-2001) to dispense the superelastic polymer ink at a feed rate lower than 1 μL/h. Pyrolyzed SU 8 carbon and Si were used as substrates. The voltage was applied to the stainless steel needle, while the substrate was grounded. The substrate to needle distance was maintained at 1 mm. The voltage was turned on after the polymer formed a full-sized droplet of approximately 500 μm diameter at the needle tip, held in place by surface tension. The polymer jet does not self-initiate under the influence of the voltage because the electrostatic force cannot overcome the surface tension at the droplet-air interface. Therefore, the electrospinning process was initiated by introducing an artificial instability at the droplet-air interface with a glass microprobe tip (1 to 3 μm tip diameter) that resulted in a very high local electric field, sufficient to overcome the interfacial surface tension, giving rise to the formation of the Taylor cone and initiation of the polymer jet.

The patterning of nanofibers onto the substrate was carried out for up to 45 min to produce a stable and controllable and continuous jet using the low voltage method described herein. Among the concentrations of PEO solutions that were tested, the use of about 2 wt % PEO solution resulted in the most controlled continuous electrospinning. The lower concentration at 1 wt % PEO formed a very thin electro-spinning jet that pinched off easily within a few seconds of initiation. Possible reasons for the latter are a faster loss of entanglement due to a lower relaxation time and a lower viscosity that reduces jet resistance to the bending instabilities, both causing easier breakage of the jet. Conversely, the 3 wt % PEO solution forms a thicker jet due to its higher viscosity and higher conductivity, both of which are known to increase the effective polymer flow rate. The 3 wt % PEO jet tends to harden before the onset of electrospinning and this hardening is likely caused by premature solvent evaporation during its longer flight in air due to an increased resistance to momentum change emanating from a higher viscosity.

The polymer jet was initiated at a higher voltage within the range of 400-600V at a first voltage level, also known as the initiation voltage, to obtain a visible jet. After initiation the voltage was lowered to a second, lower voltage level, i.e., an operational voltage, which can be as low as about 200V with approximately 1 mm source-to-substrate operating distance using 2% PEO. The operational voltage at the second, lower level may fall within a lower range that depends on the exact composition of the polymer. For example, PEO blended with other polymers like PEDOT may have a higher "lower range" while blending with high viscosity SU8 may lead to lower "lower range." It is generally believed that the lower range of the second, lower level voltage that will encompass most if not all such compositions is between about 100V to about 300V. This is a significant improvement over conventional FFES methods that utilize voltages in excess of 1,000V at 10-15 cm operating distances. The low-voltage NFES setup allows seamless electrospinning with superior control of nanofiber thickness and alignment.

With less bending instabilities in the polymer jet, slower stage speeds (20-40 mm/s) may be employed clearly demonstrating that the low-voltage NFES technique substantially reduces bending instabilities by operating at unprecedented low voltages made possible by the viscoelastic ink formulation. Previous reports by Chang et. al. (cited above) and Sun et. al. on use of NFES for aligned patterning have required higher voltages combined with faster stage movement (120-1500 mm/s)—an obvious impediment to improving patterning precision. See Sun, D et al., Near-field electrospinning, Nano Lett., 6(4), 839-42 (2006).

Another advantage of lower voltage operation lies in reduction of the diameter of the jet, leading to thinner nanofibers. This is most likely due to the lower electrostatic forces at play that reduce the feed rate of the polymer, thus reducing jet thickness. Therefore, the voltage can be manipulated to directly control the thickness of the nanofibers. Direct evidence of this relationship was observed in real time during electrospinning when a stepwise reduction in voltage reduced the thickness of the deposited nanofiber thus causing it to scatter less light making it difficult to observe, as the voltage was reduced. The deposited pattern went from a visible line at 400 V to almost invisible at 200 V under 60× magnification in the stereo microscope used to monitor the electrospinning process.

Low voltage operation at around 200V permits the patterning of very thin nanofibers having diameters below 20 nm. Such ultrathin nanofibers seem to be porous, perhaps an effect either due to beading of the nanofibers or Pd/Au particle growth during sputtering. The fibers were sputtered with 6 nm Pd/Au layer to improve SEM resolution. This method is thus able to reproducibly pattern ultra-thin nanofibers in the range of 10-20 nm which cannot be accomplished using conventional far-field and near-field electrospinning.

All experiments were conducted on an automated X-Y microstage (Prior Scientific Inc.) that is programmed to move the substrate in any desired pattern, for instance, in a perpendicular square wave pattern. The speed of the X-Y stage has a significant effect on the physical characteristics of the deposited nanofibers. As the stage accelerated to reach a certain speed, or decelerated to change direction, the diameter of the nanofiber was found to vary substantially. Generally, lower average velocity leads to fiber thickening, and vice versa for a higher average velocity, most likely resulting from the mechanical stretching of the nanofibers between the point of contact on the substrate and the droplet. While this effect can be avoided by patterning only in the constant velocity regime, it is also feasible to use the stage motion to create a smooth continuous transition between nanofibers of different thickness for example, by gradually adjusting stage acceleration/deceleration.

Electrospinning onto 3D Structures

In another embodiment of the invention, a method may be applied to integrate low-voltage NFES "writing" capability with three-dimensional ("3D") substrates by suspending nanofibers on carbon micropost arrays located on a Si substrate. In an example of this "writing" capability, posts having a height of 40 μm, a diameter of 30 μm, an interpostal distance of 100 μm were used. These carbon post arrays are fabricated by the pyrolysis of high-aspect ratio SU-8 structures in a reducing environment. See e.g., Kudryashov et al., "Grey scale structures formation in SU-8 with ebeam and UV," Microelectron Eng. 67, 306-311 (2003); Malladi et al., "Fabrication of suspended carbon microstructures by e-beam writer and pyrolysis," Carbon, 44, 2602-2607 (2006); Wang et al., "A novel method for the fabrication of high aspect ratio CMEMS structures," J. Microelectromech Syst. 14, 348-358 (2005).

The writing of suspended polymeric nanofibers between carbon posts in an array was successfully carried out at a voltage of 200V. In this experiment, nanofiber deposition was monitored in situ through a stereo microscope. SEM images in FIG. 7 show that both individual and multiple nanofibers 801 were directly suspended between the posts 802. These nanofibers 801 can be coated with metal to function as connectors and sensing elements on 3D microstructures. In the latter case, the sensing elements will exhibit higher signal-to-noise ratio compared to flat electrode geometries, resulting in enhanced sensitivity for chemical and biological sensors. Pyrolysis of these polymeric nanofibers into carbon will also enable conductive behavior with additional shrinkage of dimension and versatile functionalization chemistry.

Formulations of the Polymer Solution

Figure 8:
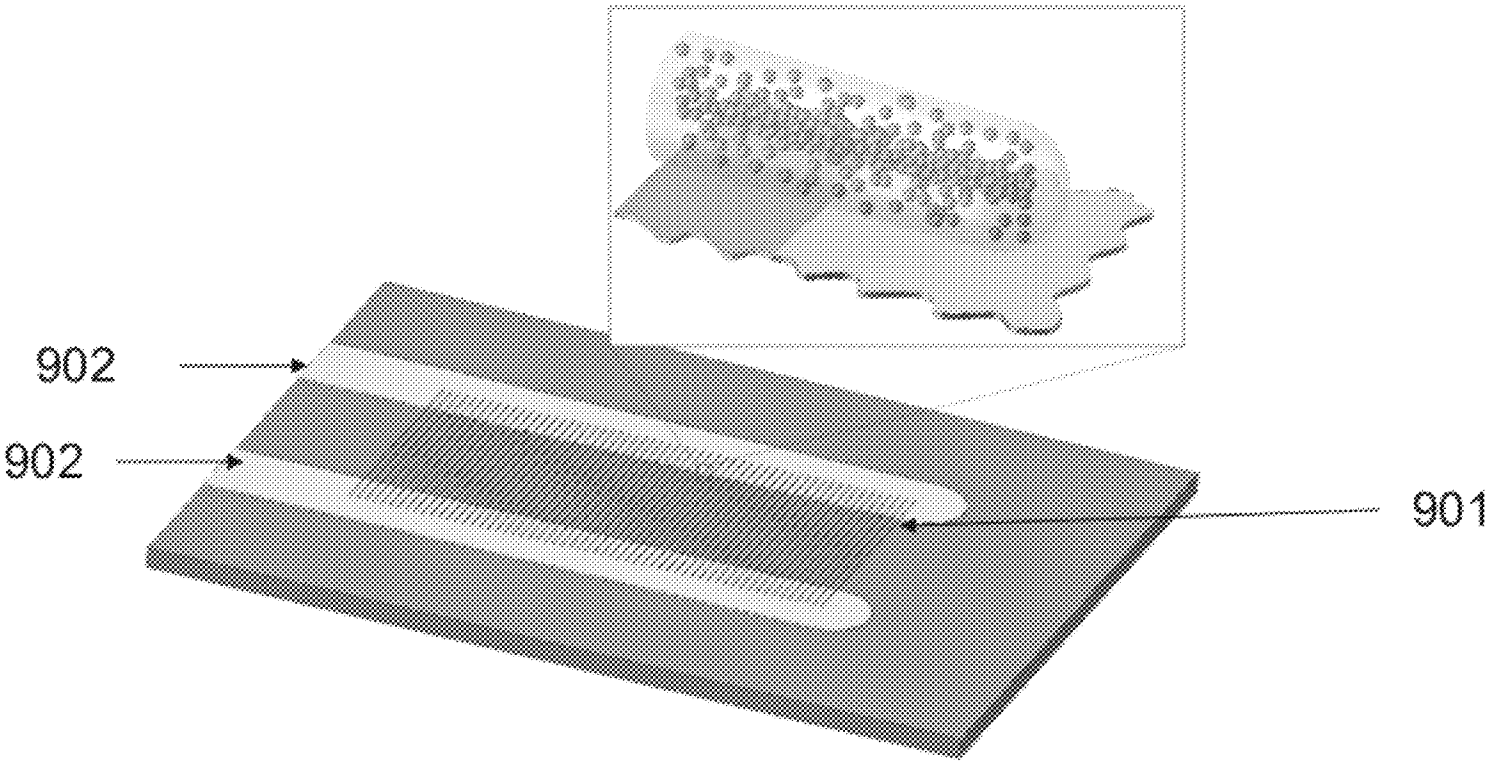
FIG. 8 illustrates a schematic of the deposition layout of the PEO:PEDOT:PSS nanofibers between the gold electrodes. The inset schematically shows the arrangement of PEDOT: PSS islands in PEO solution.
Figures 9A, 9B, 9C:
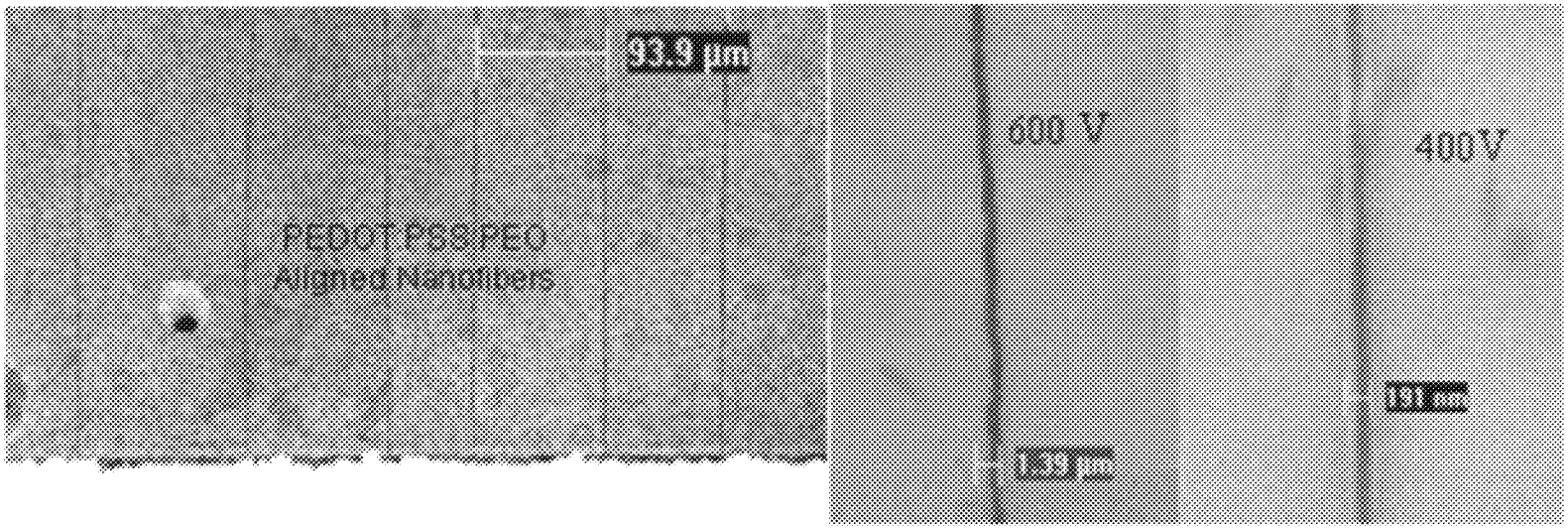
FIG. 9A illustrate SEM images of PEDOT: PSS: PEO aligned nanofiber arrays deposited between gold pads, one end of which is illustrated in FIG. 9A.
FIG. 9B illustrate SEM images of PEDOT: PSS: PEO aligned nanofiber arrays deposited between gold pads produced at 600V.
FIG. 9C illustrate SEM images of PEDOT: PSS: PEO aligned nanofiber arrays deposited between gold pads produced at 400V. Comparing between FIGS. 9C and 9B, the higher voltage produces thicker nanofibers.

For continuous electrospinning operations, the optimum polymer mix is observed to be within the range of about 20% to about 30% PEDOT:PSS dispersion concentration in 1.6-2.0% PEO base solution where the % refers to the wt/v %. For example 2% PEO refers to 2 g of PEO in 100 ml of solvent (e.g., water). This formulation can be electrospun under different humidity conditions ranging from about 40% to 80% relative humidity. The nozzle-to-substrate distance varies in the range of about 1.0 to about 1.5 mm. The nanofibers are electrospun continuously with a stable polymer jet. FIG. 8 depicts a model for the distribution of PEDOT:PSS in the PEO bulk polymer specifically a set of approximately one hundred (100) nanofibers 901 laid down for testing into a parallel array on the gold electrodes 902. The inset of FIG. 8 shows the arrangement of PEDOT:PSS islands in PEO solution. The nanofibers are conductive when the PEDOT:PSS islands are in contact with each other Several polymer blends, different humidity levels and various nozzle-to-substrate distances were tested to achieve a stable nanofiber jet that was then used to lay down an array of one hundred (100) parallel conducting nanofibers between two gold pads separated 0.5 mm apart as shown in FIG. 9A. This topology allowed for easy measurement of the conductivity of the resulting nanofibers. An optimal balance of viscosity, elasticity and conductivity was established to ensure continuous nanofibers. At high concentrations of PEDOT:PSS (e.g., 30-60% w/v PEDOT in 1.8% to 2% w/v PEO) led to spraying of short vertical fibers that dried before reaching the substrate while too low PEDOT: PSS concentrations (e.g., 0-20% w/v PEDOT in 1.8% to 2% w/v PEO) did not produce conductive nanofibers. As expected, a higher deposition voltage (600V) produced thicker nanofibers in the range of 1 μm as shown in FIG. 9B while a lower deposition voltage (400V) produced thinner nanofibers with diameters in the range of 200 nm as also shown in FIG. 9C.

At lower concentrations of PEDOT:PSS dispersion in PEO, the dispersion forms PEDOT:PSS polymer islands in the PEO bulk solution. This impedes the conductivity of the mixture since the PEDOT:PSS polymer chains have to be in contact to conduct electricity effectively. Moreover, the distribution of the islands is highly random and the electrospun nanofibers obtained with PEDOT:PSS concentration below 20% are usually non-conductive. Conversely, a very high concentration of PEDOT:PSS (>30%) in PEO results in a highly conducting solution. This formulation also has lower viscoelasticity due the short PEDOT:PSS polymer chains, which interfere with the entanglement of the long PEO polymer chains thereby reducing elasticity. Thus, the near field electrospinning of this formulation generally leads to multiple short vertical microfibers instead of continuous electrospinning of individual nanofibers. The vertical fibers dry before reaching the substrate, producing an array of standing microfibers.

PEDOT:PSS exist as a particle dispersion in water that, upon mixing with PEO, is re-distributed as individual islands in the PEO matrix. This generally restricts the conductivity of PEDOT:PSS in PEO. However, at a critical concentration the individual islands start forming contacts with each other yielding a conductive pathway. This critical concentration is found to be at around 20% PEDOT:PSS in PEO.

As explained herein, electrospinning is initiated at an initial, high voltage (e.g., a voltage above 600V). Once a polymer jet is induced, the voltage is then reduced to thin down the jet of ink for the production of nanofibers. A direct correlation is observed between the voltage and thickness (or diameter) of the nanofibers as previously described herein. The deposition of the nanofibers is carried out on a Si wafer coated with a 500 nm thick insulating $SiO_2$ layer. In the experimental setup, the nanofibers were laid down between two gold electrode strips 2 mm wide, separated by 1 mm gap. The current-voltage (I-V) characteristics of the nanofibers was then measured between these gold electrodes using a high precision Potentiostat in two electrode voltammetric mode. In addition, the conductivity of the nanofiber arrays between the gold pads was measured with a multimeter. The resistance was found to be in the range of few hundred kΩs for thicker fibers and few MΩs for the thinner fibers.

Figure 10:
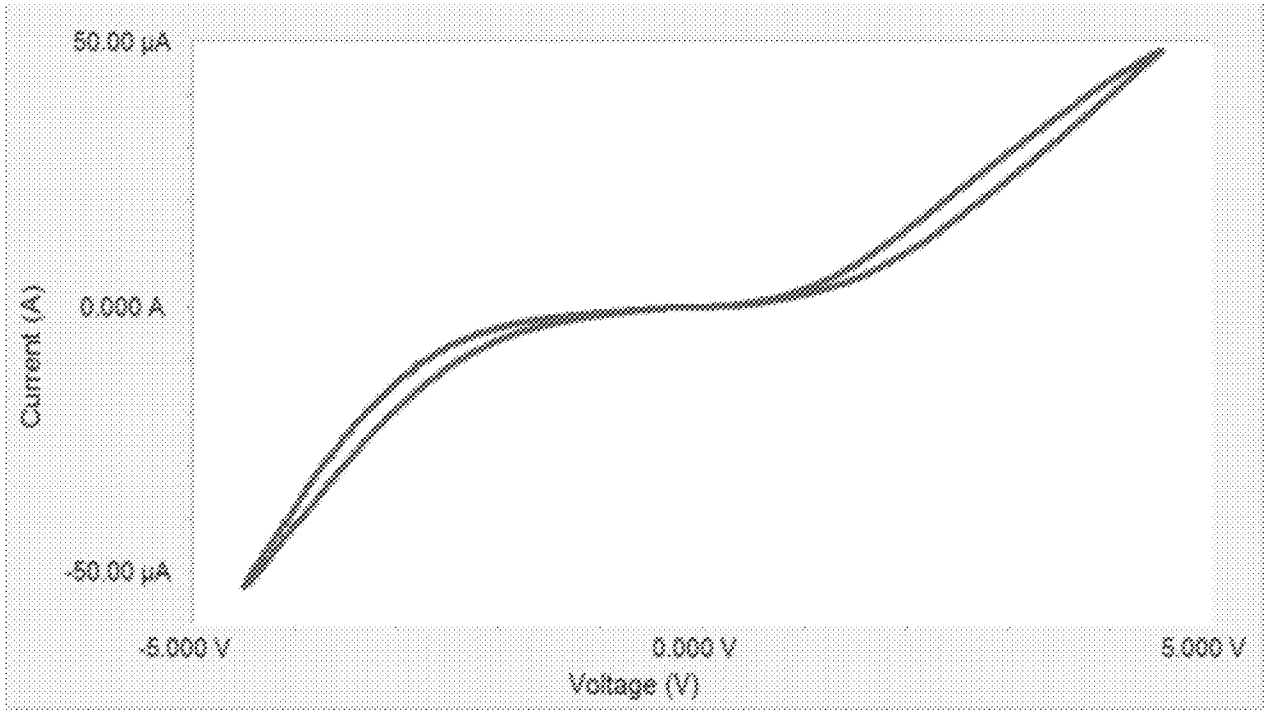
FIG. 10 illustrates a current-voltage (I-V) curve of PEDOT: PSS:PEO nanofibers deposited at 400V.

The current-voltage (I-V) response of thinner nanofibers deposited at 400V is seen in the graph illustrated in FIG. 10. The two curves illustrate variations in the output current since the nanofibers were scanned multiple times. The variations are due to hysteresis caused by thermal noise in the polymer chain. The I-V response in FIG. 10 is very similar to a Schottky-diode characteristic. The Schottky-diode characteristic indicates the formation of a Schottky-barrier formed between the nanofiber and the gold electrode contact. This Schottky-barrier is believed to be caused by the lower PEDOT content in the nanofibers. This can be better understood as resulting from a smaller number of conducting PEDOT islands on the nanofiber surface, leading to a non-ohmic electrical contact. Similar formation of Schottky barriers have also been reported by Hongzhi et. al. and Wang et. al. in carbon nanotubes laid down on metal electrodes and used for making infrared sensors See C. Hongzhi et al., "Development of Infrared Detectors Using Single Carbon-Nanotube-Based Field-Effect Transistors," Nanotechnology, IEEE Transactions on, vol. 9, no. 5, pp. 582-589 (2010); Wang et al. "A novel method for the fabrication of high-aspect ratio C-MEMS structures," Microelectromechanical Systems, Journal of, vol. 14, no. 2, pp. 348-358 (2005).

Figure 11:
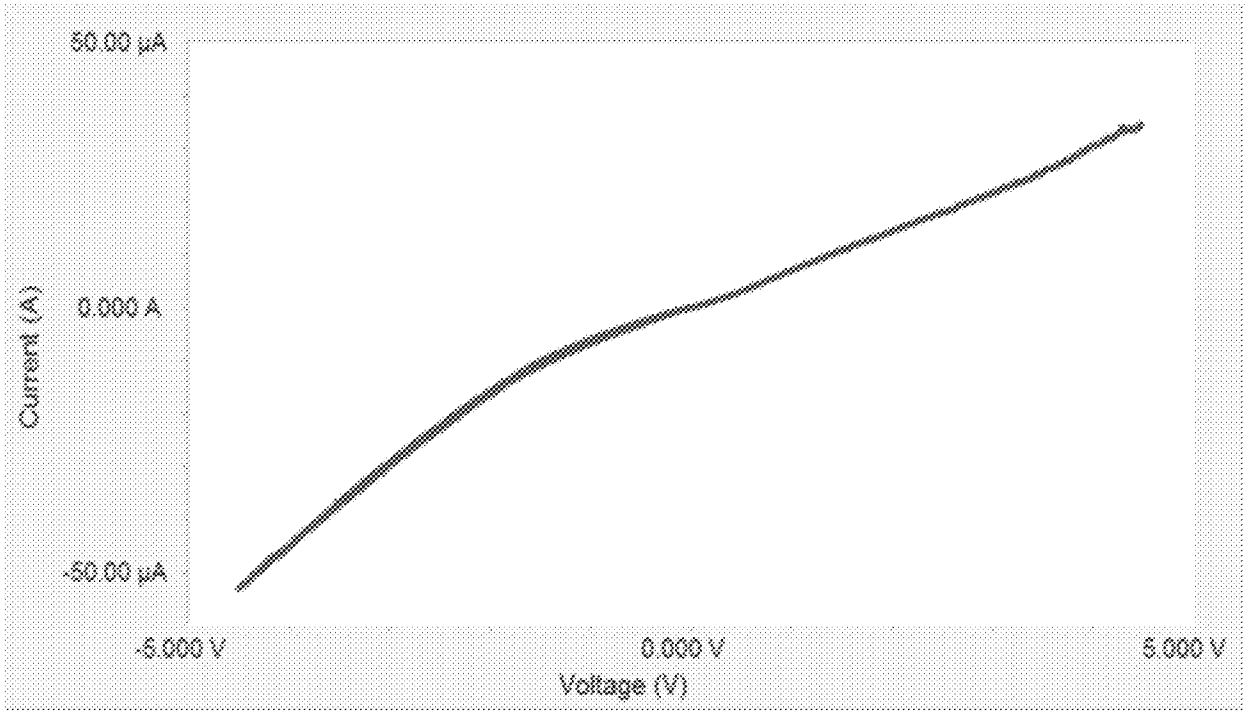
FIG. 11 illustrates a current-voltage (I-V) curve of PEDOT: PSS:PEO nanofibers deposited at 600V.

The I-V response of thicker nanofibers deposited at 600V is shown in FIG. 11. This response is largely ohmic, unlike the thinner fibers, indicating the formation of a better electrical contact between the nanofiber and the electrode. This technique can be used in continuous writing of conducting nanofibers on flexible substrates to form simple circuit elements that can be utilized for building fully integrated polymer devices. LV-NFES offers complimentary and enhanced capability to conventional printing technologies for conducting polymers due to the wide range of dimensions that can be produced using LV-NFES on a single substrate using a single printing technique.

While the addition of SU8 to high molecular weight PEO permits the ink formulation to be pyrolysed, the use of SU8 directly as an ink for NFES does not allow continuous electrospinning due to the limited viscoelasticity of SU8. To address this problem, blending of high molecular weight PEO with SU8 attributes the mixture, the viscoelastic properties of PEO and the carbonization properties of SU8. In this regard, mixture of PEO to SU8 in gamma-Butyrolactone (GBL) as a solvent is employed for electrospinning on the NFES setup. The resulting mixture is electrospun in different ratios leading to the generation of micro/nanofibers as shown in FIG. 12.

The resulting mixture was easily electrospun in different ratios but lead to the generation of thicker fibers. A 50:50 ratio of SU8:HMW-PEO is found to achieve the right balance of solvent evaporation induced hardening and stretchability resulting in continuous electrospinning A higher ratio of SU8 led to the drying of the electrospinning jet. A stepper motor stage was programmed to move the Si substrate in a zig-zag square wave pattern.

Figure 12:
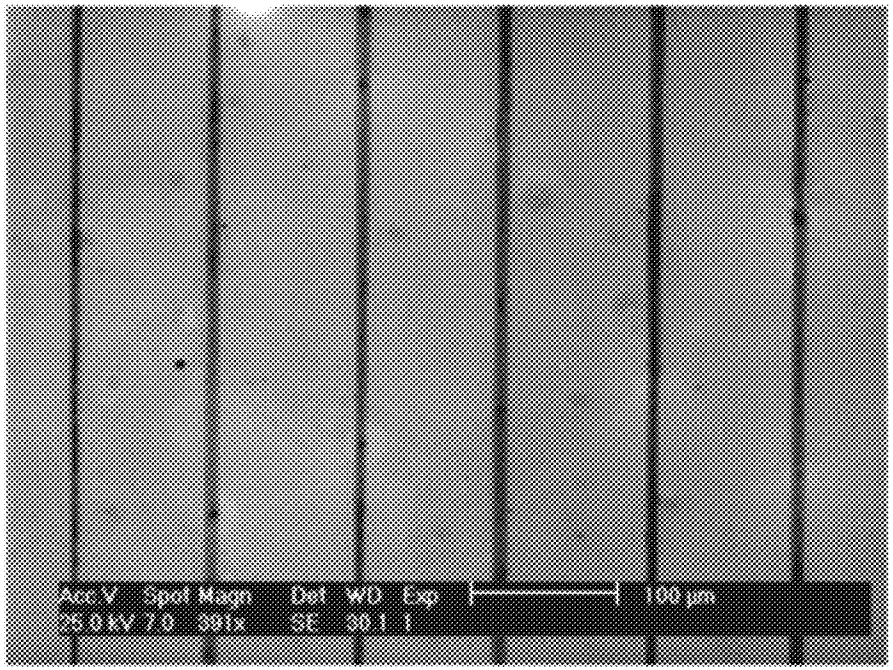
FIG. 12 illustrates electrospun fibers using the blend of SU8 and PEO deposited in an array.
Figure 13B:
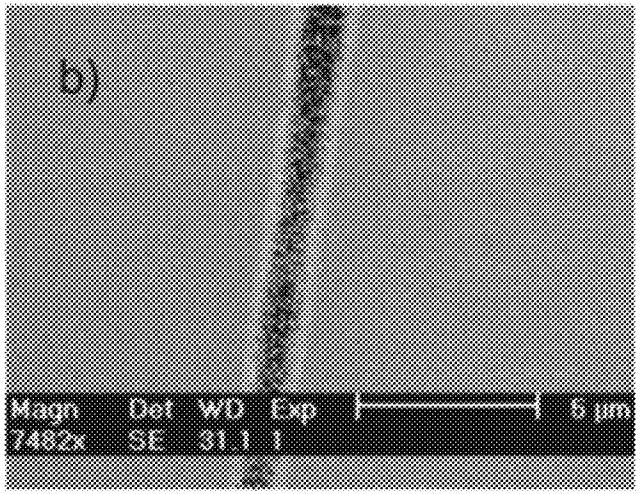
FIG. 13B illustrates an electrospun fiber generated at high stage speed after carbonization.
Figure 13A:
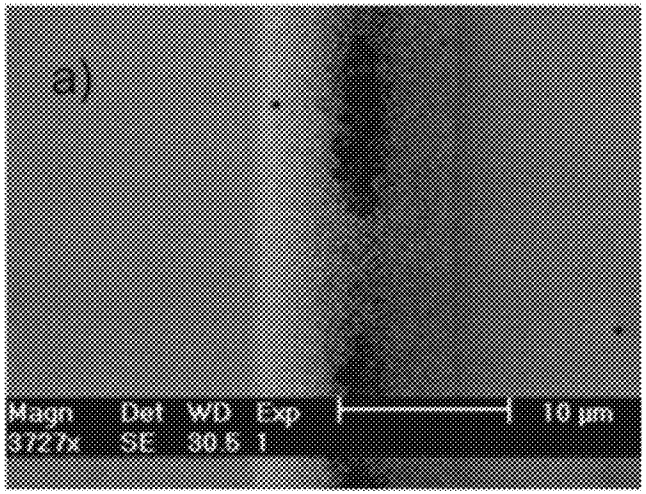
FIG. 13A illustrates an electrospun fiber generated at low stage speed after carbonization.
Figure 14:
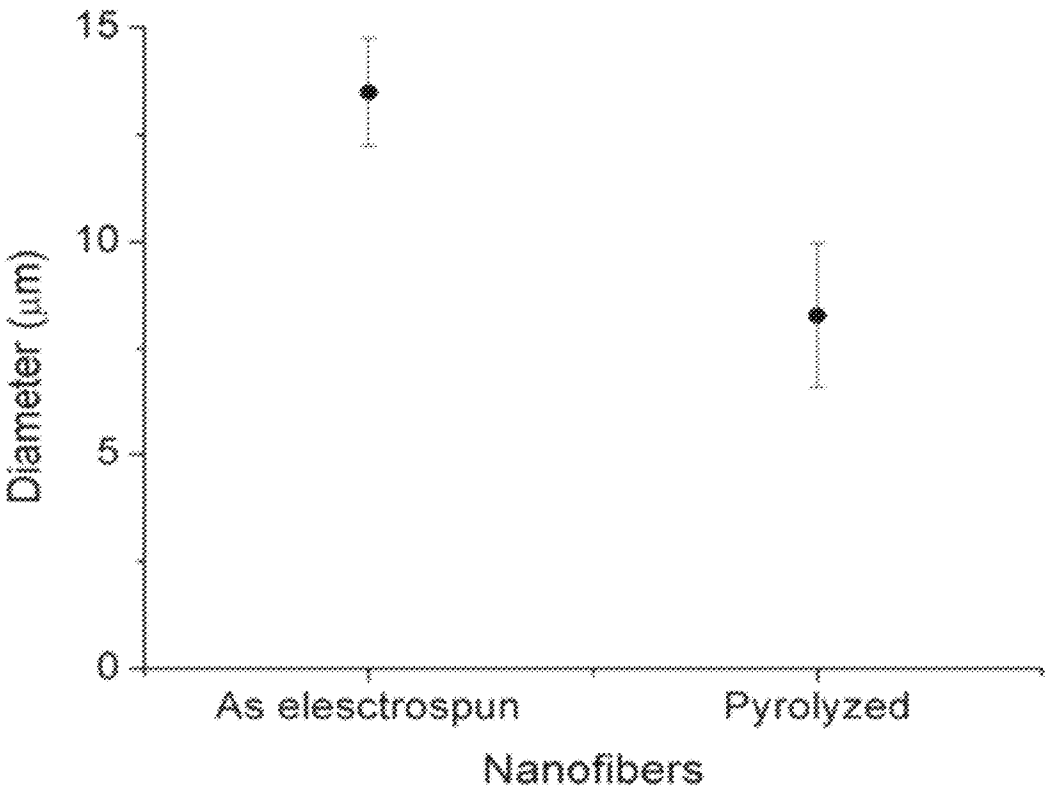
FIG. 14 illustrates the degree of shrinkage in the diameter (i.e., thickness) of electrospun fibers after pyrolysis.

The fibers as shown in FIG. 12 are pyrolysed at 900° C. under an $N_2$ gas flow rate of 2500 sccm throughout the process. It is seen that the PEO:SU8 blend fibers were carbonized into carbon fibers after pyrolysis. Significant porosity is observed in the fibers as seen in the SEM pictures in FIGS. 13A and 13B represented by the darker porous regions of the fiber. The two carbonized fibers shown in FIGS. 13A and 13B are obtained at different stage speeds. The diameter of the fibers is found to shrink by approximately 40% after pyrolysis as seen in the date illustrated in FIG. 14.

While embodiments have been shown and described, various modifications may be made without departing from the scope of the inventive concepts disclosed herein. The invention(s), therefore, should not be limited, except to the following claims, and their equivalents.

What is claimed is:

1. An electrospinning method comprising:

providing a nozzle fluidically coupled to a source of polymer ink;

providing a substrate adjacent to the nozzle;

applying a first voltage to the nozzle to initiate electrospinning of the polymer ink onto the substrate, wherein the first voltage is within the range of about 400V to about 1000V;

reducing the voltage to a second, lower voltage wherein the voltage is within the range of about 600V to about 150V;

moving the substrate in at least one of the x, y, and z directions relative to the nozzle at different speeds so as to alter the diameter of polymer ink reaching the substrate; and wherein the polymer ink comprises less than 3.0 (wt %) PEO having a molecular weight of about 4,000,000.

2. The method of claim 1, further comprising moving the nozzle in at least one of the x, y, and z directions relative to the substrate.

3. The method of claim 1, further comprising controlling at least one of the acceleration, deceleration, or speed of the substrate to cause a gradual change in the thickness of the electrospun ink.

4. The method of claim 2, further comprising controlling at least one of the acceleration, deceleration, or speed of the nozzle to cause a gradual change in the thickness of the electrospun ink.

5. The method of claim 1, wherein the distance between the nozzle and the substrate is within the range of about 1 mm and about 3 mm.

6. The method of claim 1, wherein substrate moves relative to the nozzle such that the electrospun polymer can be further stretched mechanically.

7. The method of claim 1, further comprising pyrolysing the polymer ink.

8. The method of claim 1, wherein the polymer ink comprises high molecular weight PEO with an aqueous dispersion of PEDOT:PSS.

9. The method of claim 8, wherein the polymer ink comprises between about 20% to about 30% (wt %) PEDOT:PSS dispersion concentration in 1.6-2.0 (wt %) PEO base solution.

10. The method of claim 1, wherein the polymer ink comprises a photoresist.

11. The method of claim 10, wherein the photoresist comprises a carbonizable negative photoresist.

12. The method of claim 11, wherein the polymer ink further comprises gamma-Butyrolactone (GBL).

* * * * *